US005970585A

United States Patent [19]

Scholey

[11] Patent Number: 5,970,585

[45] Date of Patent: Oct. 26, 1999

[54] BUCKLE FOR A RESPIRATOR MASK

[75] Inventor: Michael Forbes Scholey, Pacoima, Calif.

[73] Assignee: Moldex-Metric, Inc., Culver City, Calif.

[21] Appl. No.: 09/132,372

[22] Filed: Aug. 11, 1998

[51] Int. Cl.[6] ..... A44B 21/00; B65D 63/00

[52] U.S. Cl. ..... 24/482; 24/16 PB; 24/163 FC; 24/300; 2/452

[58] Field of Search ..... 24/482, 300, 301, 24/304, 265 EE, 3.3, 131 C, 163 CF, 164

[56] References Cited

U.S. PATENT DOCUMENTS

| | | | |
|---|---|---|---|
| 282,285 | 7/1883 | Dessart | 24/300 |
| 1,720,295 | 7/1929 | Schwartzman | 24/300 |
| 2,065,202 | 12/1936 | Weidhorn | 24/163 FC |
| 2,924,827 | 2/1960 | Stollman | 24/163 FC |
| 4,607,398 | 8/1986 | Faulconer | 2/452 |
| 4,658,478 | 4/1987 | Paradis | 24/16 PB |
| 5,317,788 | 6/1994 | Esposito et al. | 24/300 |
| 5,448,805 | 9/1995 | Allen et al. | 24/482 |
| 5,638,584 | 6/1997 | De Anfrasio | 24/300 |

FOREIGN PATENT DOCUMENTS

| | | | |
|---|---|---|---|
| 0609783 | 11/1960 | Canada | 24/300 |

*Primary Examiner*—Victor N. Sakran
*Attorney, Agent, or Firm*—Charles H Schwartz

[57] ABSTRACT

A buckle located around a resilience strap and a method of manufacturing includes a resilient strap material provided on a continuous basis and having a particular width and thickness. The strap material is stretched to reduce the width and thickness of the strap material at a particular position. A mold member is provided to form a buckle and the buckle is molded around the strap at the particular position where the strap material is reduced in width and thickness to increase the friction between the buckle and the strap material.

12 Claims, 2 Drawing Sheets

BUCKLE FOR A RESPIRATOR MASK

BACKGROUND OF THE INVENTION

The present invention relates to a buckle of the type that can be used with a respirator mask and specifically relates to buckle members that are integrally molded on a strap on a continuous basis.

Buckles are used as part of a respirator mask to allow the user of the mask to put the mask on and take the mask off in an easy fashion. Part of the difficulty with prior art buckles are that they are somewhat cumbersome in structure and thereby expensive to manufacture. The present invention relates to a buckle which is simple in construction and easy to manufacture.

SUMMARY OF THE INVENTION

In the buckle of the present invention, the buckle is formed by two buckle members molded around an elastic band and locked in position onto the elastic band using a novel method of manufacture. Specifically, if a buckle member is merely molded around an elastic band, when the molding process is over and the buckle member cools, the elastic band would slip within a molded channel formed in the molded buckle member. This is because the elastic material when stretched tends to reduce in size thereby allowing for slippage of the band inside the buckle member.

The present invention overcomes this problem by pre-stretching the elastic band prior to the molding of the buckle members around the elastic band. The buckle members are actually molded around the elastic band in the stretched condition so that the elastic band within the channel in the molded member is actually stretched to a smaller size. When the molded buckle members cool, the band portion is already stretched and locked by friction in position within the channel. The stretched band wants to return to its unstretched state and this tends to increase the friction. Further pulling on the elastic band does not produce any significant further stretching of the band within the buckle members. The buckle member therefore is held tightly onto the elastic band by friction during use and the elastic band cannot slip out of the buckle.

DETAILED DESCRIPTION OF THE INVENTION

Figure 1:
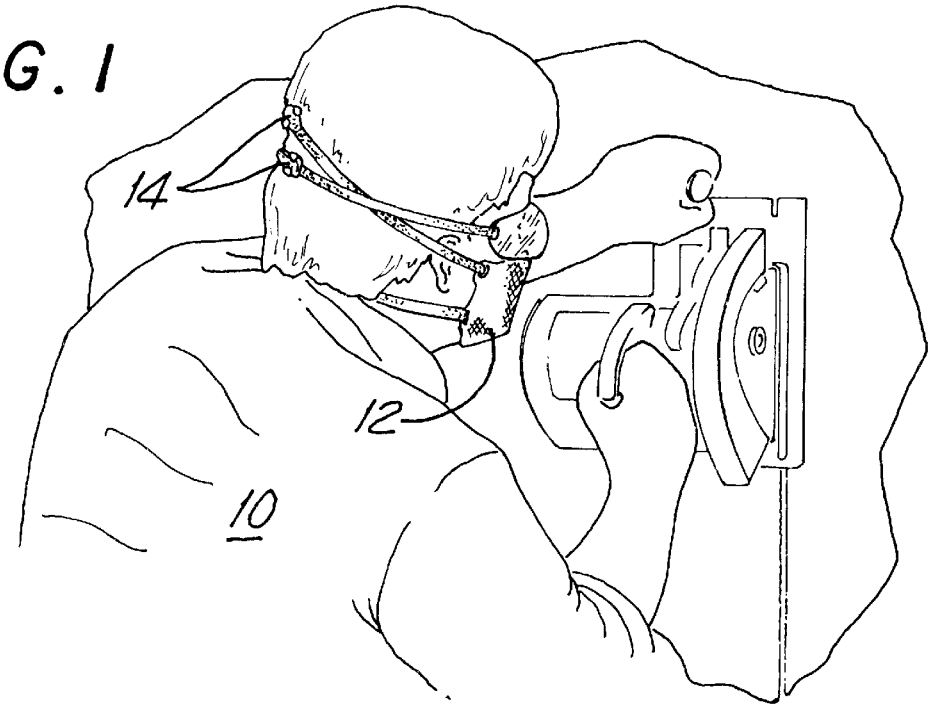
FIG. 1 illustrates a user of a respiratory mask and showing the buckles of the present invention at the back of the mask.

As can be seen in FIG. 1, a user 10 of a respirator mask 12 is operating a piece of machinery. The respirator mask 12 includes a pair of buckles 14 located at the back of the mask.

Figure 2:
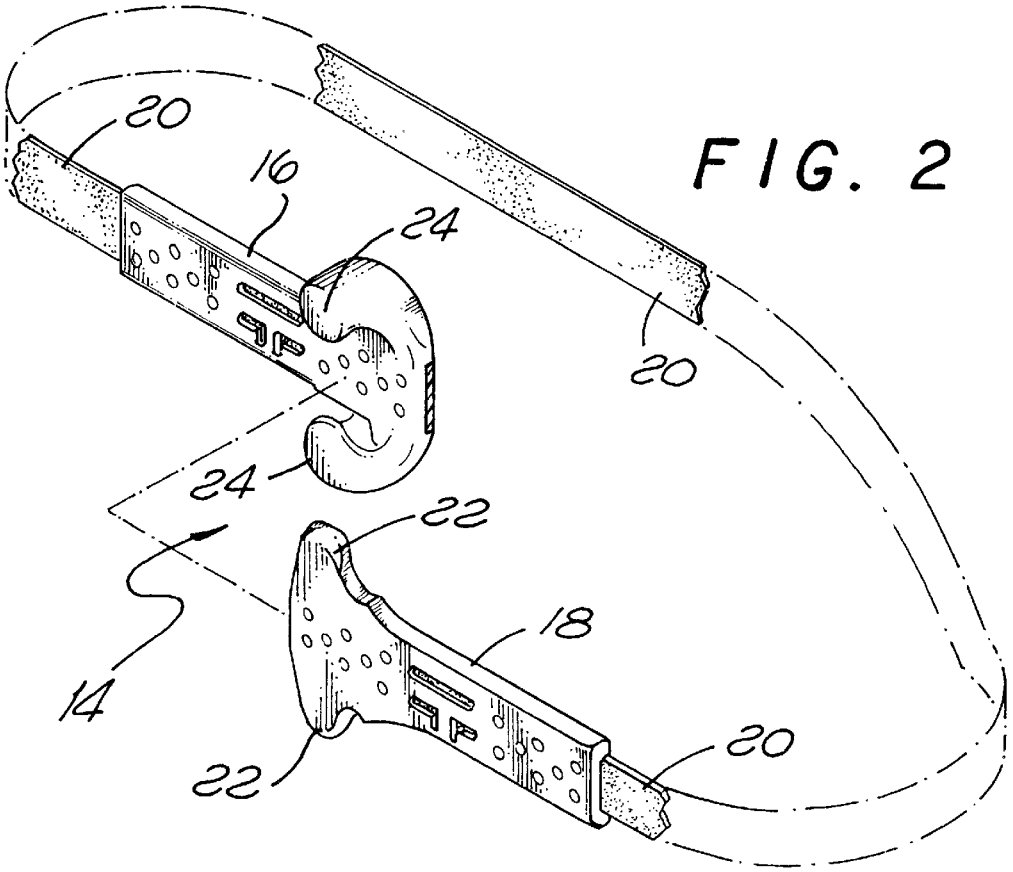
FIG. 2 is a detailed perspective view of two buckle members which form the buckle of the present invention.

FIG. 2 illustrates that the buckle 14 is composed of two component buckle members 16 and 18 each located at the end of a strap member 20. As shown in FIG. 2 the buckle members 16 and 18 are molded around the strap 20 and form the end portions for the strap 20.

Figure 3:
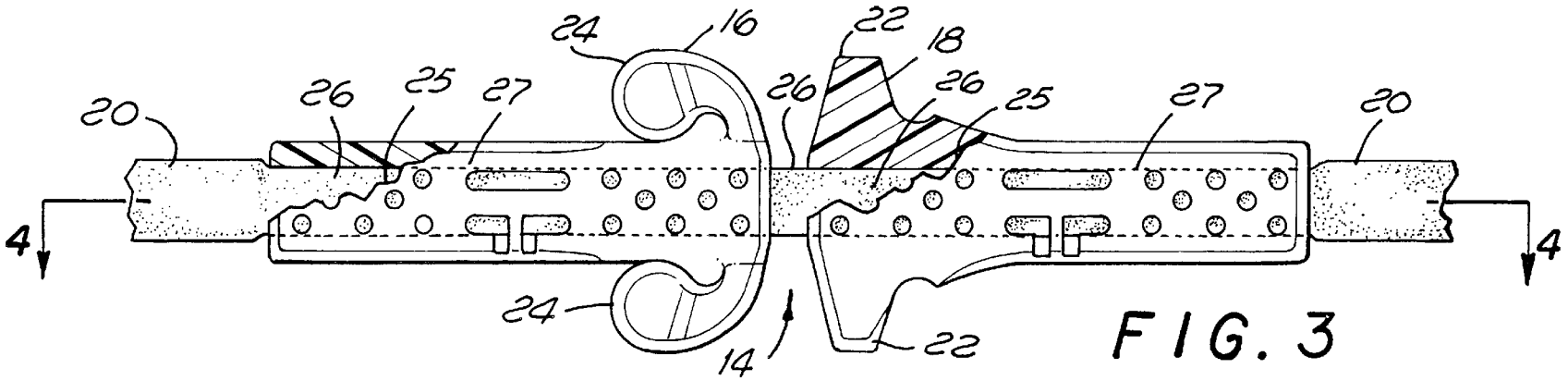
FIG. 3 illustrates the buckle members formed on an elastic band before the buckle members are separated.
Figure 4:
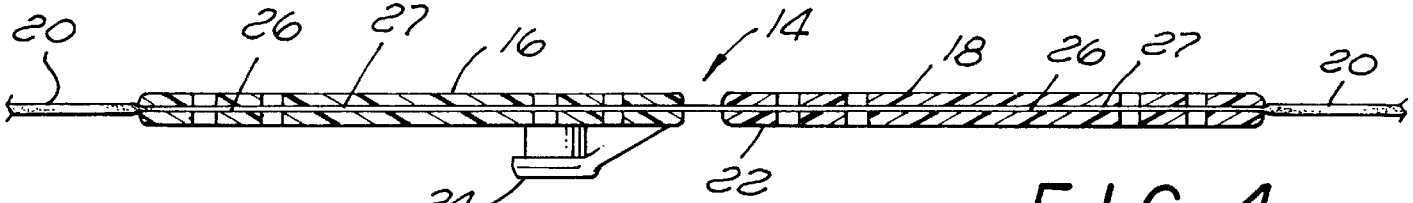
FIG. 4 is a cross-sectional view taken along lines 4—4 of FIG. 3.

FIGS. 3 and 4 illustrate the buckle 14 in top and cross-sectional views. As can be seen in FIGS. 3 and 4, the strap member 20 runs continuously through buckle members 16 and 18. As will be explained later, the strap member 20 is parted to form the two separate buckle end members 16 and 18 shown in FIG. 2. As can also be seen in FIGS. 3 and 4 the end portion of buckle member 18 is formed as outwardly extending wing portions 22. These wing portions 22 fit within outwardly extending flange members 24 formed at the end of buckle member 16. The buckle 14 is thereby engaged or disengaged easily by merely slipping the wing members 22 to interlock with the flange members 24. This can also be seen in the perspective view of FIG. 2.

FIG. 3 also shows broken way portions 25 which illustrate that the strap 20 becomes narrower in a length of the strap 26 which is located within molded channels 27 in the buckle members 16 and 18. Similarly FIG. 4 shows that the strap portion 26 is also thinner in the channels 27 which are contained within the buckle members 16 and 18. The molded channels 27 are the result of stretching the strap member 20 to be narrower and thinner while the buckle members 16 and 18 are molded around the strap member. This insures that upon cooling the strap portion 26 will be locked within the molded channels 27 formed in the molded buckle members 16 and 18.

Figure 5:
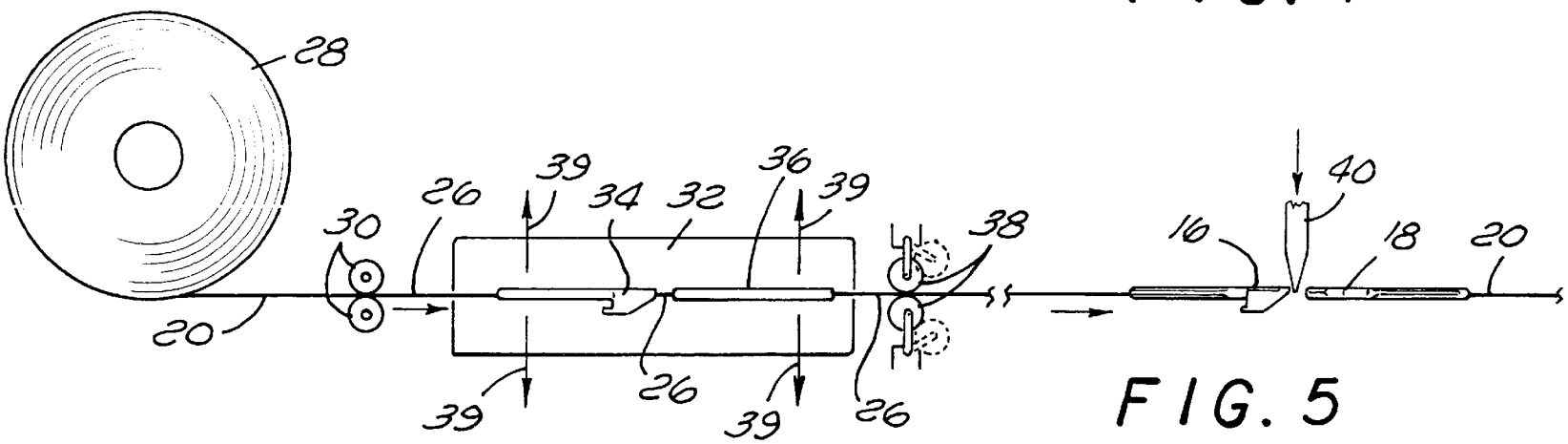
FIG. 5 illustrates an apparatus and method for making the buckle members of the present invention on a continuous basis.

FIG. 5 illustrates an apparatus for practicing the method of making the combined strap and buckle of the present invention. As shown in FIG. 5, a large roll 28 of the elastic strap 20 plays out the strap material through a pair of rollers 30. The rollers 30 not only pull the strap material from the roll 28 but also provide a specific rolling speed dependent upon the speed of rotation of the rollers 30. The strap material then passes through a mold 32 which has the configuration to mold the buckle members 16 and 18 as shown by mold cavities 34 and 36. These mold cavities will provide for the exact mold details for the buckle members 16 and 18 as shown in FIGS. 2, 3 and 4.

The strap material 20 is also being pulled by rollers 38. The rollers 38 are operated at a greater rotational speed than the rollers 30 and as such provide for a constant tension in the strap material in the portion 26 between the rollers 30 and the rollers 38. In this way the strap material 26 located within the mold 32 and specifically the mold portions 34 and 36 would be thinner and narrower than the strap material 20 coming off of the roll 28. The buckle members 16 and 18 are molded in position around the strap material 26 until the molded portions cool and the mold is separated as shown by arrows 39.

The rollers 38 are moved away, as shown by the dotted position in FIG. 5, to have the molded buckle members 16 and 18 located on the strap member brought to a position where a parting knife 40 parts the strap material at a position in-between the buckle members 16 and 18. Prior to parting the continuous assembly including the strap member 20, buckle member 16 and buckle member 18 will be as shown in FIGS. 3 and 4.

The strap member 20 may be made of any type of suitable elastic material such as natural rubber or thermoplastic elastomers sold under trade names Dynaflex and Santoprene or braided elastic (cloth covered elastic). In order to insure that the strap members cannot be pulled out from buckle member 16 and 18, the amount of additional stretching prior to molding can range anywhere between 75% to 500% dependent upon the type of material used. In a specific example using natural rubber as the material for the strap member, the additional stretching that has been found acceptable has typically been between 100% to 150%. With this amount of stretch, the size of the elastic strap 26 within the channels 27 in the buckle members 16 and 18 is reduced significantly, relative to the unstretched strap.

Although the invention has been described with reference to a particular embodiment, it should be appreciated that various adaptations and modifications may be made and the invention is only to be limited by the appended claims.

I claim:

1. A method of manufacturing a buckle located around a resilience strap including the following steps, providing resilient strap material having a particular width and thickness, stretching the strap material to reduce the width and thickness of the strap material at a particular position, providing a mold member to form a buckle located around the strap at the particular position, molding a buckle around the strap at the particular position where the strap material is reduced in width and thickness, and removing the buckle now integrally molded around the strap material having the reduced width and thickness while allowing the strap material at positions exterior to the buckle regain the original width and thickness.

2. The method of claim 1 wherein the step of stretching the strap material stretches between 75% to 500% more than the unstretched strap material.

3. The method of claim 1 wherein the step of stretching the strap material stretches between 100% to 150% more than the unstretched material.

4. The method of claim 1 herein the mold member is provided to produce a buckle formed by two buckle members interconnected by strap material and including the additional step of parting the strap material interconnecting the buckle members.

5. The method of claim 1 wherein the strap material is provided to be natural rubber or thermoplastic elastomer.

6. The method of claim 1 wherein the strap material is provided to be a braided elastic.

7. The buckle and integral strap of claim 1 wherein the strap is stretched between 100% to 150% more than the unstretched strap.

8. A buckle and integral strap formed by the following method, providing a resilient strap having a first width and thickness dimension in a normal state and reduced width and thickness dimension in a stretched state, forming the strap with a first length portion in the normal state and a second length portion in the stretched state, molding a buckle around the strap in the length portion of the strap in the stretched state, and locking the buckle in position on the strap by the friction between the strap and the buckle and with the friction increased because of the stretched position of the strap.

9. The buckle and integral strap of claim 8 wherein the strap is stretched between 75% to 500% more than the unstretched strap.

10. The buckle and integral strap of claim 8 wherein the buckle is formed by two buckle members interconnected by the strap.

11. The buckle end integral strap of claim 8 wherein the strap is formed of natural rubber or thermoplastic elastomer.

12. The buckle and internal strap of claim 8 wherein the strap is formed by a braided elastic.

* * * * *